United States Patent [19]

Watermann

[11] 4,272,036

[45] Jun. 9, 1981

[54] LINE REEL

[75] Inventor: David R. Watermann, Elgin, Ill.

[73] Assignee: Keson Industries, Inc., Naperville, Ill.

[21] Appl. No.: 39,329

[22] Filed: May 16, 1979

Related U.S. Application Data

[63] Continuation of Ser. No. 930,683, Aug. 3, 1978, abandoned.

[51] Int. Cl.[3] ..... B65H 75/40; B65H 75/16

[52] U.S. Cl. ..... 242/96; 242/84.8

[58] Field of Search ..... 242/96, 84.8, 100

[56] References Cited

U.S. PATENT DOCUMENTS

| | | | |
|---|---|---|---|
| 874,130 | 12/1907 | Stanley | 242/96 |
| 1,768,078 | 6/1930 | Krause | 242/100 |
| 2,589,500 | 3/1952 | Landon | 242/84.8 |
| 3,044,731 | 7/1962 | Zelnick | 242/84.8 |
| 3,311,319 | 3/1967 | Campbell | 242/96 |
| 3,438,595 | 4/1969 | Brown | 242/96 |

*Primary Examiner*—Edward J. McCarthy

*Attorney, Agent, or Firm*—Wegner, Stellman, McCord, Wiles & Wood

[57] ABSTRACT

A line reel includes a spool for line, a drive shaft effecting rotation of the spool through suitable gears and a manually operable crank hinged to the drive shaft. The drive shaft has a clutch part releasably engageable with a cooperating clutch part on one of the gears. A cam surface on the crank causes the crank, when pivoted to a selected locked or cranking position, to be moved to an over-center position at which a spring holds the crank in selected position. In locked position, the clutch parts are disengaged and the spool stops are engaged. In cranking position, the clutch parts are engaged and the stops are disengaged. The crank may be moved to disengage both the stops and the clutch parts so that the wound line may be manually extended from the spool without effecting rotation of the crank.

13 Claims, 5 Drawing Figures

LINE REEL

This is a continuation of application Ser. No. 930,683 filed Aug. 3, 1978, now abandoned.

BACKGROUND OF THE INVENTION

This invention relates generally to a line reel and, more particularly, to such a reel having a crank for rewinding line on the reel which can be locked or unlocked as desired.

In the prior art, line reels are known. Typically, in a line reel such as a chalk line reel, a spool of line is journaled within a chalk-filled housing so that line unwound from the spool end and payed out of the housing is covered with chalk. In one form of prior art reels, a crank directly drives the spool. In another form, gears are employed to drive the spool and increase the rate at which the line may be rewound.

During use, it may be desirable to manually pull the chalk line from the spool until the required length of line has been extended from the housing. At other times, it may be desirable to prevent the line from being pulled from the housing as, for example, when the line is being used to mark a guide line. In conventional direct drive and gear drive reels, manual extension of the line causes the crank to turn, while the line can only be locked by manually holding the crank fixed relative to the housing. Clearly, this kind of operation is not desirable.

A clutch mechanism has been provided to release the crank from the spool to permit unwinding of line from the spool without causing the crank to be turned. The above clutched reel also has a structural configuration permitting the spool to be locked in position. However, no means has been provided to positively maintain the spool in a locked position until affirmatively released by the operator.

SUMMARY OF THE INVENTION

It is a principal object of the invention to provide a line reel, such as a chalk line reel, having a clutch for disengaging the crank from the spool and having means for positively locking the spool in fixed position until released.

In accordance with the invention, a line reel includes a crank pivotally connected to one end of a drive shaft with the other end of the drive shaft having a clutch part releasably engageable with a cooperating clutch part on one of the gears driving the spool. The crank provides a cam surface at its pivoted end such that when the crank is pivoted to a selected locked or cranking position, it is moved to an over-center position at which a spring biasing the clutch parts towards engagement positively holds the crank in that position.

In an exemplary embodiment of the invention, the crank defines a stop member which is engageable, when the crank is in locked position, with cooperating stops on one of the driving gears. The housing of the chalk line reel is formed to provide an opening through which the crank stop may be inserted. In locked position, the clutch parts are disengaged. When the crank is moved to cranking position, the stops are disengaged and the clutch parts are engaged.

In a preferred embodiment, a ramp is formed on the exterior of the housing and is adapted to cooperate with the crank. Rotation of the crank slightly from its locked position causes the crank to be lifted out of engagement with the gear stops. At this time, the clutch parts remain disengaged so that the chalk line may be manually extended from the spool without effecting rotation of the crank.

DESCRIPTION OF THE PREFERRED EMBODIMENT

Figure 1:
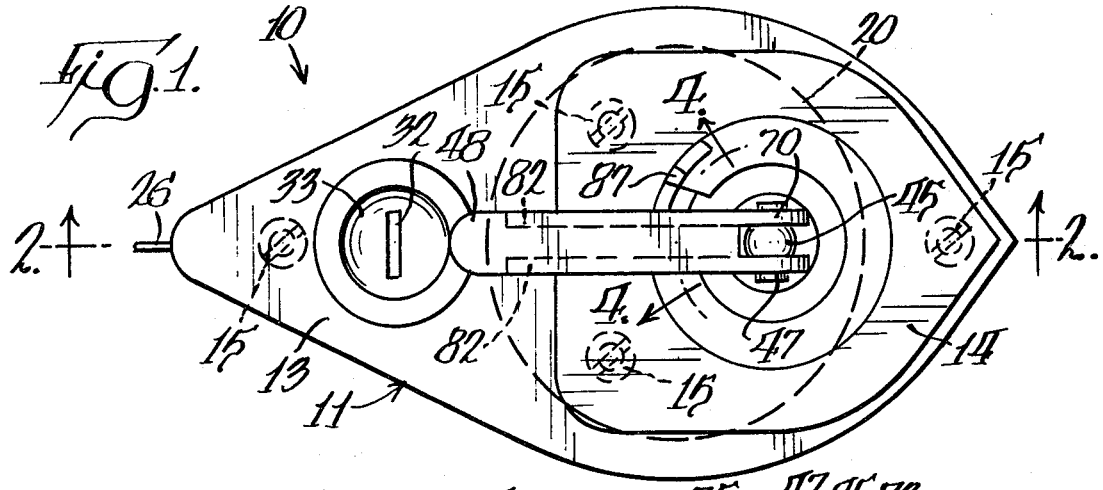
FIG. 1 is a top elevational view of an embodiment of the invention.

A chalk line reel, generally designated 10, has a housing 11 defined by a lower case part 12, an upper case part 13, and a gear case cover 14. Screws 15 are inserted through the lower case part 12 and threaded into respective bosses 16 and 17 defined by the upper case part 13 and the gear case cover 14 to secure the respective housing portions together. The lower and upper case parts 12 and 13 define a spool housing, designated 18, while the upper case part 13 and gear case cover 14 define a gear housing, designated 19.

Rotatably mounted within the spool housing 18 is a spool or reel 20 which has stub shafts 21 at each side thereof journaled by respective bosses 22 extending from the lower case part 12 and the upper case part 13. The spool 20 has a center hub 24 and enlarged rims 25 at either side thereof so that a line or cord 26 may be wrapped around the hub 24. Disposed between the rim 25 and the upper case part 13 is a felt washer 27. The line 26 extends from the spool 20 and externally of the housing 11 through an aperture 29 formed at the forward end of the generally pear-shaped housing 11. A brass washer 31 resides in the aperture 29 to prevent wear by the line 26 on the housing 11, which may be formed from plastic. Positioned internally adjacent the aperture 29 is a sponge rubber wiper 30 which removes excess chalk from the line 26, a supply of powdered chalk being maintained within the spool housing 18. The spool housing 18 may be refilled with chalk by injecting chalk through a slit 32 defined in a rubber valve body 33 which seals a circular hole 34 defined in the upper surface of the upper case part 13.

Mounted with the gear housing 19 is a spur gear 40 connected to the square end 41 of the spool stub shaft 21, an internal ring gear 44 in meshed engagement with the spur gear 40, and a drive shaft 45 for driving the ring gear 44. Hinged to the external end of the drive shaft 45 by a pivot pin 47 is a crank handle 48.

The internal ring gear 44 has a peripheral wall 50 with inwardly extending gear teeth 51 and a central boss 52 with a cylindrical recess 53 defined therein and an internal flange 55 defining a square aperture 56. Projecting upward from the upper case part 13 is a stub shaft 58 which extends through the aperture 56 into the recess 53. The ring gear 44 rotates about the axis defined by the stub shaft 58. The ring gear teeth 51 mesh with the gear teeth 60 of the spur gear 40 such that when the ring gear 44 is rotated, the spur gear 40 is also rotated, thereby rotating the spool 20.

The drive shaft 45 has a circular bore 62 formed at the inward end thereof which permits the inward end of the drive shaft 45 to be impaled on the stub shaft 58. The gear case cover 14 defines an aperture 64 through which the drive shaft extends to an external exposed position. Thus, the drive shaft 45 is supported for rotation by the stub shaft 58 and the periphery of the aperture 64. The inward end of the drive shaft 45 has a square cross section thereby defining a clutch part 66 that is engageable with the square aperture 56, which defines a cooperating clutch part.

Formed adjacent the inward end of the drive shaft 45 is an annular shoulder 65 which is disposed within the recess 53 of the central boss 52 and is of a size to maintain alignment between the drive shaft 45 and the ring gear 44. The position of the ring gear 44 is maintained during rotation by the annular shoulder 65 which bears on the wall of the recess 53, the position of the shoulder 65 being maintained by the stub shaft 58. A coiled compression spring 68 placed between the shoulder 65 and a washer 69 bearing against the inner surface of the gear case cover 14 biases the drive shaft 45 downward onto the stub shaft 58. As a result, the clutch part 66 is also biased into engagement with the aperture 56.

The crank handle 48 has a bifurcated end 70, an operating knob 71 at the opposite end and a post 72 intermediate the end 70 and the knob 71. The end 70, which is pivotally connected to the drive shaft 45, defines a cam surface 73 at the periphery thereof. The pivot pin 47 is located at a point spaced from the center of the circular cam surface 73. Portions of the cam surface 73 lie at varying distances from the pivotal connection of the crank handle 48 to the drive shaft 45. Thus, the pivot pin 47 passes through an off-center point which is spaced from the center point in a direction which is toward the knob 71 and toward the crank bottom 75 away from the crank top 76. The distance between the pivot connection and the portion of the cam surface 73 contacting the exterior of the gear housing 19 is thereby greater when the crank handle 48 is pivoted to a folded, locked position (FIG. 2) than when the crank handle is pivoted to an unfolded, cranking position (FIG. 3). In locked position, the drive shaft 45 is retained against the action of the spring 68 at an outward position with the clutch parts 56 and 66 disengaged.

Figure 2:
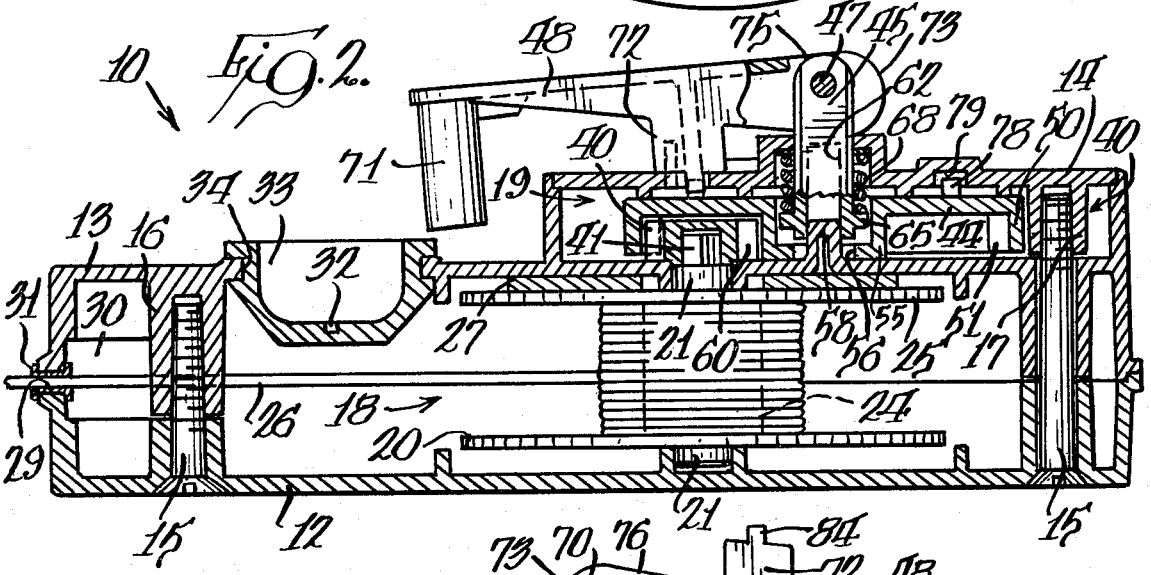
FIG. 2 is an enlarged, cross-sectional view of the invention taken along line 2—2 of FIG. 1 showing the crank in locking position.
Figure 3:
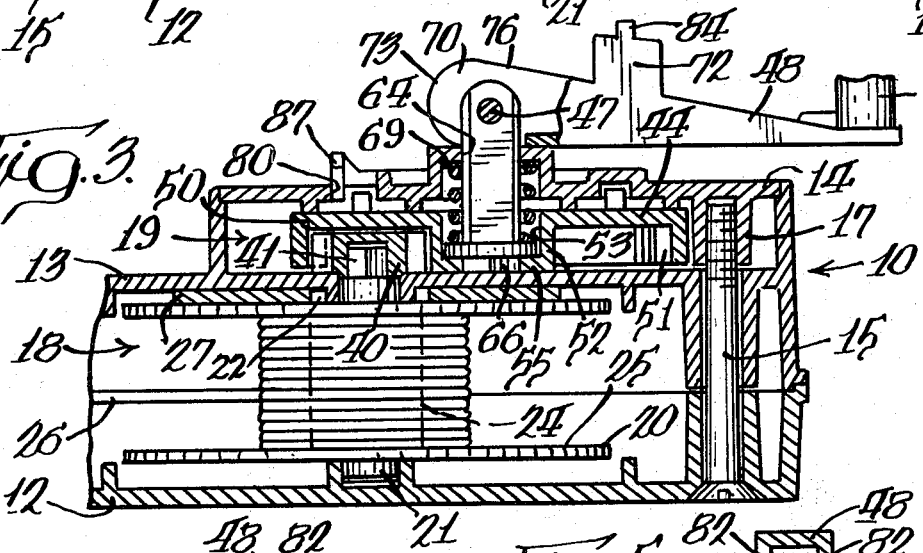
FIG. 3 is an enlarged, fragmentary cross-sectional view similar to FIG. 2, but showing the crank in cranking position.

At locked and cranking positions, the crank handle is at an over-center position so that the spring 68 biases the drive shaft 45 downward and thereby biases the crank handle 48 in a counterclockwise direction as seen in FIG. 2 or in a clockwise direction as seen in FIG. 3.

The cam surface portions adjacent the cam portions contacting the gear housing exterior when the crank handle 48 is at either locked or cranking positions lie at a distance from the pivot connection such that the crank handle 48 can be pivoted counterclockwise about the pin 47 only by lifting the crank handle 48 against the action of the spring 68.

Located on the outer surface of the ring gear 44 is an annular array of spaced stop lugs 78 which will rotate through an annular recess 79 formed in the gear case cover 14 when the ring gear 44 is rotated. Defined in the gear case cover 14 is a slot 80 which is aligned with the stop lugs 78. The handle post 72 is defined by a pair of spaced walls 82 depending from the crank handle 48 and structurally supported by a crossbar 83. A stop pin or lug 84 extends from one of the side walls 82 and is adapted to pass through the slot 80 to engage one of the lugs 78 extending upward from the ring gear 44.

Figure 4:
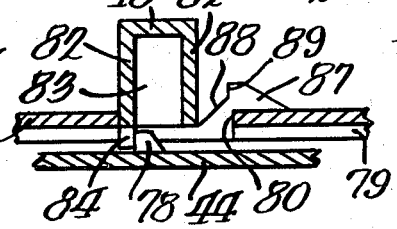
FIG. 4 is an enlarged, fragmentary development taken along line 4—4 of FIG. 1 showing the crank crossbar blocking the ring gear against rotation.

As seen in FIGS. 2 and 4, when the lug 84 interferes with the lugs 78, rotation of the ring gear 44 and hence the spool is prevented. Maintenance of this engagement between the lugs 78 and 84 is effected by the spring 68 which draws the over-center pin 47 downward, thereby effecting downward rotation of the crank handle 48. It is, of course, understood that the internal ring gear 44 may be provided with spaced slots so that when the crank handle 48 is rotated to its locked position, the pin 84 will engage such a slot to lock the ring gear against rotation and function substantially similar to the function provided by the lugs 78.

Figure 5:
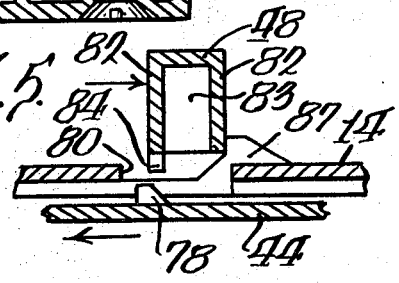
FIG. 5 is a development similar to FIG. 4, but showing the crank rotated slightly against the ramp so that the crossbar pin is lifted out of engagement with the ring gear.

Formed on the outer surface of the gear case cover 14 is a ramp 87 having a cam surface 88 and an abutment 89. Rotation of the crank handle 48 from its locked position in a clockwise direction, as viewed in FIG. 1, causes the side wall of the post 72 to ride up on the 45° cam surface 88 and thereby lift the crank handle 48 out of the slot 80 so that the pin 84 disengages the lug 78 as seen in FIG. 5. Clockwise rotation of the crank handle 48 beyond the ramp cam surface 88 is inhibited by the abutment surface 89.

Referring to FIG. 3, it can be seen that the crank handle 48 has been pivoted about the pin 47 to its unfolded cranking position with the knob 71 thereof extending upwardly for manual manipulation. In this cranking position, the pin 47 is positioned close to the top surface of the gear case cover 14, thereby permitting the spring 68 to bias the drive shaft 45 into clutched engagement with the internal ring gear 44. The crank handle 48 will remain in unfoled cranking position by the action of the spring 68, since the pin 47 will be in an over-center position with respect to the cam surface 73. Hence, affirmative pivotal movement of the crank handle 48 is required to move the crank handle 48 from cranking position. In cranking position, the crank handle 48 may be rotated clockwise or counterclockwise as seen in FIG. 1 to wind or unwind the chalked line from the spool 20. This is possible because of the engagement of the clutch part 66 of the drive shaft with the square aperture 56 of the internal ring gear 44.

When the crank handle 48 is in its folded locking position as shown in FIG. 2 or is rotated up the ramp 87 as seen in FIG. 5, the drive shaft 45 is disengaged from the internal ring gear 44. When the square pin 84 protrudes through the gear case cover 14 and interferes with the upstanding lugs 78 on the ring gear, counterclockwise rotation of the spool 20 is prevented even if outward force is exerted on the line 26.

When the crank handle 48 is rotated up the ramp 87 by rotating the crank handle 48 clockwise from its locked position approximately 15°, the spool 20 is placed in a free-wheeling position. During this movement, the crank handle 48 is cammed out of engagement with the lugs 78 by the interaction of the cam surface 88 and the post 72. Because the clutch spring 68 is in a slightly compressed state at this time, this 15° rotation is made against slight spring pressure. When the crank handle 48 is at such a free-wheeling position, the line may be manually extended to unwind line from the spool 20 which is rotatable independently of the crank handle 48 and the drive shaft 45. Upon releasing the crank handle 48, spring pressure pulls the crank handle 48 back down the cam surface 88 to its locked position.

To rewind the line 26 on the spool 20, the crank handle 48 is returned to its cranking position as seen in FIG. 3 to lower the drive shaft 45 into engagement with the internal ring gear 44, thereby connecting the drive shaft 45 through gears to the spool 20.

The internal ring gear arrangement enables a large gear ratio to be obtained in a minimum amount of space. Herein, this ratio is 3.5 to 1, i.e., the spool 20 turns three and a half times for each revolution of the crank handle 48. This makes rewinding and replacement of line much faster.

It is understood that the chalk line reel with its clutched cranking mechanism may be used without powdered chalk for a variety of purposes. For example, the reel may be used for storing and retrieving, as a kite string and/or fishing line.

I claim:

1. In a line reel including a spool for winding line thereabout, a case in which the spool is rotatably mounted and having an aperture through which the line extends, and gear means in engagement with the spool for driving the spool to wind or unwind line thereon, the improvement comprising:

a clutch part carried by the gear means;

a rotatable shaft for driving the gear means having a complementary clutch part at one end adapted to releasably engage the clutch part on the gear means and having its other end external of the case, said shaft being movable between a first position in clutched engagement with the gear means and a second position disengaged from the gear means;

means for biasing said shaft into clutched engagement with the gear means; and a crank for turning said shaft having one end pivotally connected to the external end of said shaft for selective pivotal movement between cranking and locked positions, said crank defining cam means at the one end thereof adapted to engage the case, said cam means being eccentric relative to the pivot connection between the crank and shaft so that said crank is maintained by the action of said biasing means at a selected one of said cranking and locked positions, said cam means maintaining said shaft in disengaged position when said crank is at its locked position and permitting said biasing means to move said shaft to engaged position when said crank is at its cranking position.

2. The line reel of claim 1 wherein said shaft is moved inward toward the case for engagement of said clutch parts and outward for disengagement, said cam means including the peripheral surface of said crank at the one end thereof which is held in contact with the exterior of the case by the action of said biasing means, portions of said peripheral surface lying at varying distances from the pivotal connection of said crank to said shaft such that the distance between the pivotal connection and the portion of the peripheral surface contacting the case exterior is greater when said crank is at its locked position than at its cranking position so as to retain said shaft against the action of said biasing means at an outward position with said clutch parts disengaged and pivotal movement of said crank to a position adjacent either of its locked and cranking positions effects engagement of a peripheral surface portion which is at a distance greater than the respective first-mentioned distances, whereby said crank is at an over-center position when at one of its locked or cranking positions.

3. The line reel of claim 2 wherein said peripheral surface is circular and the pivotal connection is made at a point spaced from the center point of said peripheral surface in a direction away from the one end of said crank.

4. The line reel of claim 1 further including a cam surface defined by the case for engaging said crank when said crank is at its locked position and is turned to pivot said crank away from its locked position and effect disengagement of said stop means, the spool thereby being rotatable independently of said crank.

5. The line reel of claim 1 wherein the gear means includes a spur gear connected to the spool for rotation therewith and an internal ring gear in meshed engagement with said spur gear, said ring gear having a peripheral portion having gear teeth, a center portion defining the complementary clutch part and a side wall portion connecting the center portion and the gear teeth.

6. The line reel of claim 1 additionally having exposed stop means carried by the gear means; and complementary stop means carried by said crank for engaging the stop means of the gear means when said crank is at its locked position to prevent rotation of the gear means and hence the spool.

7. The line reel of claim 6 wherein the gear means includes a spur gear connected to the spool for rotation therewith and an internal ring gear in meshed engagement with said spur gear, said ring gear having a peripheral portion having gear teeth, a center portion defining the complementary clutch part and a side wall portion connecting the center portion and the gear teeth, said exposed stop means being carried by said side wall portion.

8. The line reel of claim 7 wherein the case defines a housing for the spool and a housing for said gears, said shaft extending from said gear housing with said crank cam means reacting on the exterior of said gear housing, said gear housing having an opening therethrough exposing the side wall portion of said ring gear and the stop means thereon.

9. The line reel of claim 5 wherein said center portion of said ring gear has a recess with an internal flange at one end, the internal flange defining a non-circular aperture functioning as the clutch part of the gear means, said shaft extending through said recess with its one end having a size and configuration similar to said aperture to function as the complementary clutch part of said shaft, said shaft being movable within said recess into and out of said aperture to respectively engage and disengage said clutch parts.

10. The line reel of claim 9 wherein said recess is cylindrical and at least a portion of said shaft is of a corresponding size and configuration so as to maintain the ring gear and shaft in alignment with each other.

11. The line reel of claim 10 wherein said shaft has an axial bore at said one end thereof and further including a stub shaft carried by the case extending through said aperture in said ring gear and into said axial bore, said stub shaft thereby rotatably supporting and guiding said shaft into and out of engagement with said aperture.

12. The line reel of claim 10 wherein said shaft portion is a shoulder extending radially outward from said shaft and said biasing means is a compression spring acting between said gear housing and said shoulder to bias the one end of said shaft into said aperture.

13. In a line reel including a spool for winding line thereabout, a case in which the spool is rotatably mounted and having an aperture through which the line extends, and gear means in engagement with the spool for driving the spool to wind or unwind line thereon, the improvement comprising:

a clutch part carried by the gear means;

a rotatable shaft for driving the gear means having a complementary clutch part at one end adapted to releasably engage the clutch part on the gear means and having its other end external of the case, said shaft being movable between a first position inward of the case to engaged relation with the gear means clutch part and a second position outward from the case to disengaged relation with the gear means clutch part;

spring means for biasing said shaft inward of the case to engage the shaft clutch part with the gear means clutch part;

a crank for turning said shaft having one end pivotally connected to the external end of said shaft for selective pivotal movement between said cranking and locked positions, said crank having a peripheral cam surface at the one end thereof adapted to engage the case, said cam surface being eccentric relative to the pivot connection between the crank and shaft so that said crank is maintained by the action of said spring means at a selected one of said cranking and locked positions, said cam surface maintaining said shaft in disengaged position when said crank is at its locked position and permitting said spring means to move said shaft to engaged position when said crank is at its cranking position;

exposed stop lugs carried by the gear means;

a complementary stop member carried by said crank for engaging one of the stop lugs of the gear means when said crank is at its locked position to prevent rotation of the gear means and hence the spool; and a camming ramp surface carried by the case and adapted to engage said crank when said crank is at its locked position and is turned, turning movement of said crank causing said crank to ride up the ramp surface as it is biased thereagainst by said spring means so as to lift the stop member away from said stop lugs while maintaining disengagement of said clutch parts to permit the spool to rotate independently of said crank, said spring means returning said crank to its locked position when said crank is released.

* * * * *